US005471764A

United States Patent [19]

Krueger

[11] Patent Number: 5,471,764

[45] Date of Patent: Dec. 5, 1995

[54] CAN END DRYING OVEN

[75] Inventor: Donald R. Krueger, Watertown, Wis.

[73] Assignee: Oven Systems, Inc., Milwaukee, Wis.

[21] Appl. No.: 287,622

[22] Filed: Aug. 8, 1994

[51] Int. Cl.[6] ..... F26B 25/00

[52] U.S. Cl. ..... 34/105; 34/104; 34/218

[58] Field of Search ..... 34/105, 104, 218

[56] References Cited

U.S. PATENT DOCUMENTS

| | | | |
|---|---|---|---|
| 2,132,303 | 10/1938 | Lathrop | 34/105 |
| 4,333,246 | 6/1982 | Sullivan et al. . | |
| 4,852,271 | 8/1989 | Heckman et al. | 34/105 |

*Primary Examiner*—Henry A. Bennet

*Assistant Examiner*—Siddharth Ohri

*Attorney, Agent, or Firm*—Andrus, Sceales, Starke & Sawall

[57] ABSTRACT

An oven for drying the sealing compound on beverage and food can ends utilizes a prior art serpentine track along which a line of abutting can ends is conveyed through a drying chamber in which heated drying air is directed against the edges of the can ends through a plurality of linear nozzles. The improved apparatus of the present invention utilizes a drying chamber which substantially surrounds the track and includes a plurality of nozzles which direct a substantially uniform flow of drying air against all sides of the line of can ends. The improved apparatus is particularly effective in drying lining compounds on steel food can ends, but is suitable as well for the treatment of aluminum beverage can ends.

6 Claims, 4 Drawing Sheets

CAN END DRYING OVEN

BACKGROUND OF THE INVENTION

The present invention relates to an apparatus for drying the disk-shaped ends for beverage and food cans and, more particularly, to an improved apparatus of the type in which a continuous stack of can ends is fed through a drying chamber and caused to traverse a serpentine path while heated drying air is blown across the moving line of can ends.

Can ends for beverage and food cans are typically made of aluminum or steel and, in either case, are provided with a downturned peripheral lip which is crimped over the open end of a cylindrical can body in a seaming operation to close the container. A coating of a sealing compound is applied to the annular lip and the compound must be dried and cured before the end is attached to the can body. With the advent of water-based sealing compounds, extended drying times have been required. One particularly satisfactory apparatus for drying can ends is disclosed in U.S. Pat. No. 4,333,246. In the device disclosed in this patent, the drying oven includes a pair or pairs of rails, each forming a serpentine track which supports a line of can ends disposed in face-to-face relation for movement along the track through a drying chamber in which a pair of linear nozzles are positioned to direct convergent streams of heated drying air against the line of moving can ends. As the line of can ends traverses the horizontal curves defined by the serpentine track, the edges of the cans fan and separate slightly, allowing penetration of the drying air streams between adjacent can ends. A special feature of this prior art device orients the drying air nozzles so that over at least a portion of the serpentine track, the air streams impinge tangentially against the can ends, causing them to rotate as they move along the track through the oven. The device was designed particularly to dry relatively small diameter aluminum can ends for aluminum beverage cans which are typically provided with a pronounced edge flange. It is believed that this construction enhances the ability of the prior art can end drying ovens to cause some rotation of the can ends as they pass through the drying chamber.

Steel can ends used more commonly for food cans, on the other hand, are typically larger in diameter and somewhat flatter because they do not include as deep an edge flange as aluminum beverage can ends. As a result, steel can ends tend to stack more tightly together, and do not readily separate as they traverse the serpentine track of the drying oven disclosed in the above identified U.S. Pat. No. 4,333,246. As a result, insufficient or uneven drying of the sealing compound in steel food can ends has resulted. As the diameters of steel can ends increase, the problem tends to become worse. Typical aluminum beverage can ends are about 2⅛" (5.4 cm) in diameter. The heavier steel food can ends are made in a large number of diameters, common diameters being 3" to 4⁷⁄₁₆" (7.6 to 11.3 cm).

SUMMARY OF THE INVENTION

The present invention is directed to an improvement in the prior art can end drying apparatus and is intended particularly to overcome the unique problems presented by drying steel can ends which are typically heavier, larger, and flatter than aluminum beverage can ends. The improved can end drying oven of the present invention incorporates the prior art construction utilizing a pair of rails which form a serpentine track to support a line of disk-shaped can ends which are stacked in face-to-face relation and moved along the track through a drying chamber. The chamber includes a pair of linear nozzles positioned along the track to direct convergent streams of heated drying air against the line of moving can ends. In accordance with the improved construction of the present invention, the drying chamber is provided with an array of at least three linear nozzles, each of which is positioned along the track with the nozzles spaced from one another circumferentially around the track to provide a generally uniform flow of drying air across the moving line of can ends.

Preferably, the array of nozzles comprises four nozzles positioned to create two pairs of generally opposed drying air streams. The drying air chamber is also preferably provided with an outlet opening which extends substantially the full length of the drying chamber with the outlet opening defined by a pair of laterally adjustable nozzle plates. The drying chamber is enclosed and substantially surrounded by a drying air supply plenum which provides open communication with the nozzles to supply heated drying air thereto. In another embodiment, one or more of the nozzles may include outlet slots which are curved to conform to the curvature of the serpentine path. Preferably, a pair of such curved nozzles are utilized and disposed on opposite sides of the track. In the conventional construction wherein the serpentine path defines a series of continuous horizontal curves, the nozzles are positioned in the plane of the serpentine path.

DETAILED DESCRIPTION OF THE PREFERRED EMBODIMENT

Figure 1:
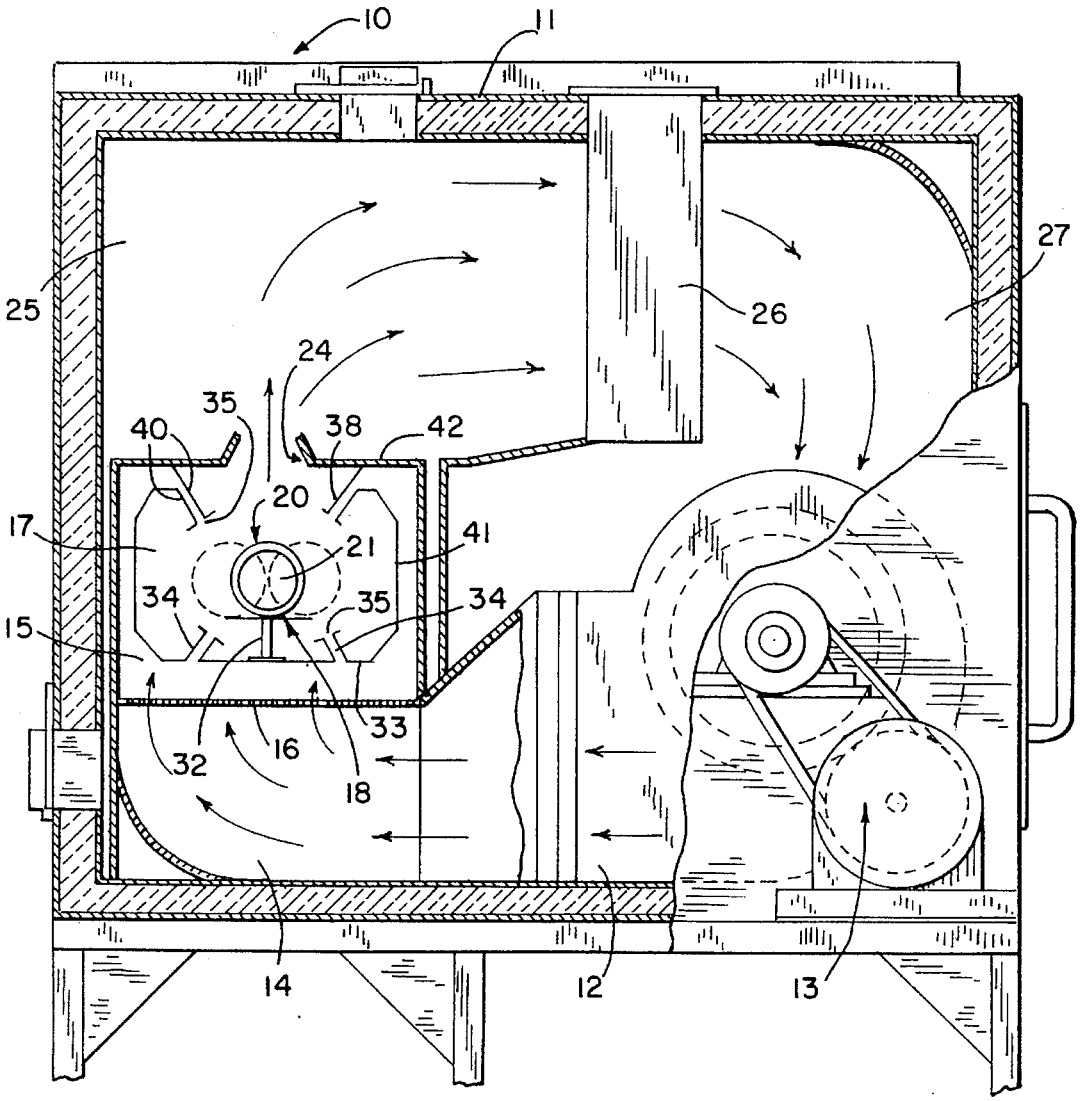
FIG. 1 is a sectional end elevation of the presently preferred embodiment of the present invention.
Figure 2:
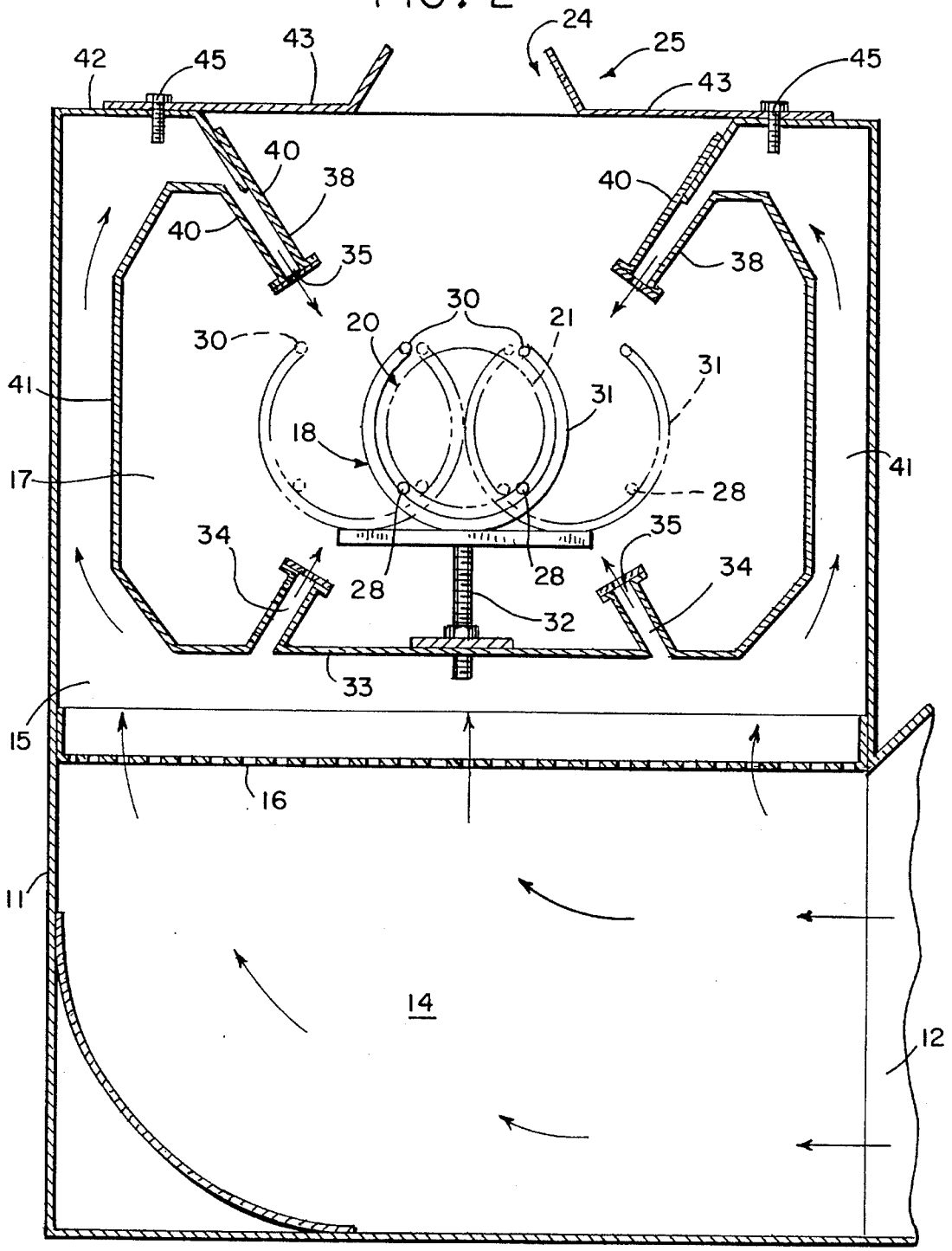
FIG. 2 is an enlarged detail of a portion of FIG. 1.
Figure 3:
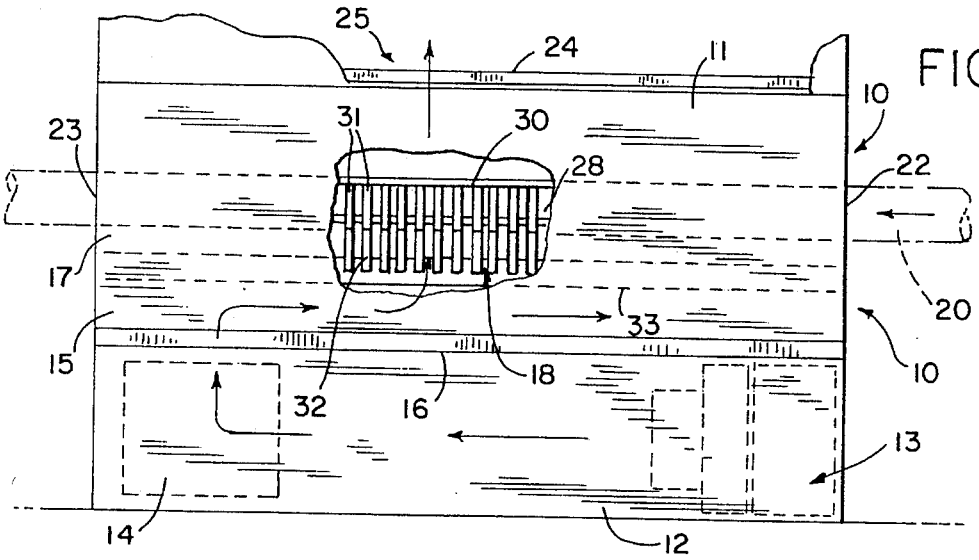
FIG. 3 is a side elevation of the drying oven shown in FIG. 1.

Referring first to FIGS. 1–3, a can end drying oven includes a substantially enclosed outer housing 11, suitably partitioned interiorly to define a lower housing 12 mounting a drying air fan and motor assembly 13, a lower inlet air plenum 14 separated from an upper drying air supply plenum 15 by a horizontal perforated defuser plate 16. Within the air supply plenum 15 and running the full length of the housing is a drying chamber 17 in which is mounted a track 18 along which a line of can ends 21 passes from an inlet opening 22 to an outlet opening 23. Drying air exits the drying chamber 17 via an air outlet slot 24 into an exhaust air plenum from which it is directed through a heater 26 into a heated air supply plenum in communication with the inlet to the fan 13. The movement of drying air through the housing 11 is shown by the series of arrows in FIGS. 1 and 2.

The track 18 along which the line of can ends 21 is conveyed through the drying chamber 17 may be constructed in accordance with the disclosure in U.S. Pat. No.

Figure 5:
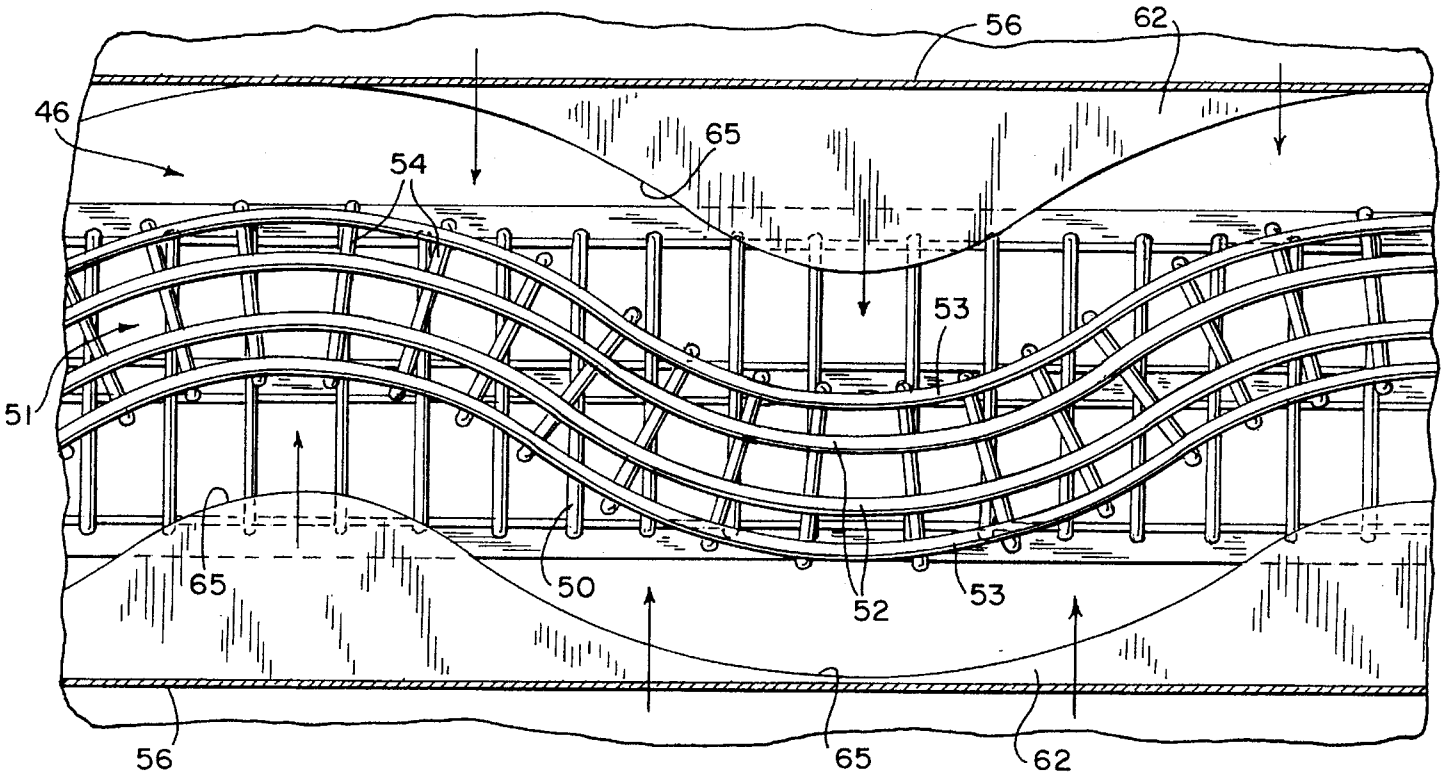
FIG. 5 is a horizontal section taken on line 5—5 of FIG. 4.

4,333,246 discussed above. The track 18 includes a pair of lower support rails 28 along which the continuous line of can ends slides as it moves through the drying chamber. The track also includes a pair of upper side rails 30 and all of the rails 28 and 30 are interconnected by upwardly opening retaining rings 31 spaced along the full length of the track. The rails 28 and 30 and the retaining rings 31 form a cage-like structure with openings small enough to prevent a can end 21 from falling through regardless of its orientation. The support rails 28 and cooperating side rails 30 are provided with multiple curve sections to define a serpentine path through the drying chamber 17. The curvature is best seen in the embodiment of FIG. 5. As the tightly stacked line of can ends 21 traverses each of the curve sections, the edges of the can ends on the outside of the curve fan and separate from adjacent can ends to provide openings for passage of the heated drying air. The next succeeding curve in the opposite direction causes the opposite edges of the can ends to similarly fan. A typical track 18 may include four reverse curve sections along its length. A suitable track support structure 32 mounts the track 18 within the drying chamber 17 above the chamber floor 33.

Figure 6:
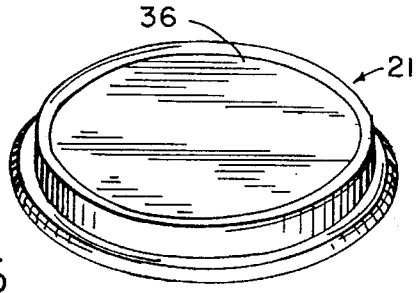

A pair of lower linear nozzles 34 extend upwardly from the drying chamber floor 33. The nozzles 34 define narrow linear slots 35 and the nozzles are oriented more or less diagonally within the chamber to direct convergent streams of heated drying air against the line of can ends 21 moving along the track 18. This is basically the nozzle structure disclosed in the apparatus described in the above identified prior art patent. Such an apparatus has been found satisfactory for drying the sealing compound applied to smaller diameter aluminum beverage can ends 36 of the type shown, for example, in FIG. 6.

Figure 7:
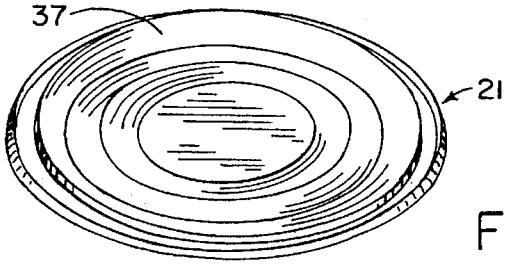
FIGS. 6 and 7 show, respectively, a conventional aluminum beverage can end and a conventional steel food can end, either of which may be processed in the apparatus of the present invention.

However, when drying larger diameter, heavier steel can ends 37 (FIG. 7), which are also substantially flatter than aluminum ends, it has been found that the drying air streams provided by a pair of lower linear nozzles 34 is insufficient to adequately penetrate the line of can ends and, as a result, non-uniform and incomplete drying results. In addition, the flatter steel can ends 37 do not present any significant surface against which the drying air streams may impinge to cause the ends to rotate as they move along the track through the drying chamber. In the preferred embodiment, the drying chamber 17 is provided with a pair of upper linear nozzles 38 which, like the previously identified lower nozzles 34, are each defined by a pair of parallel flat plates 40 which extend the length of the drying chamber, the free edges of which plates 40 define the linear slot 35.

The drying chamber 17 includes a pair of side walls 41 extending upwardly from the floor 33 and an upper wall 42 defined in part by a pair of laterally adjustable outlet plates 43 which together define the outlet opening 24 from the drying chamber. Thus, the drying chamber completely surrounds the track 18 and allows heated drying air passing upwardly through the defuser plate 16 and into the air supply plenum 15 to be directed to each of the pairs of lower and upper nozzles 34 and 38, respectively. Streams of heated drying air are thereby directed against the line of can ends from all directions in a generally uniform manner to provide thorough and more equalized curing of the sealing compound. Also, each pair of nozzles comprising one lower nozzle 34 and the diagonally disposed upper nozzle 38 provide oppositely directed drying air streams which enhances the stability of the moving line of can ends.

The induced draft provided by the fan and motor assembly 13 causes the drying air to pass from the drying chamber 17 through the upper outlet opening 24 and into the upper exhaust air plenum 25 for recirculation as described above. The outlet opening 24 extends the full length of the drying chamber but its width may be adjusted via lateral positioning of the outlet plates 43. In this regard, each of the outlet plates is attached to the upper wall 42 of the drying chamber with a series of suitable fastener assemblies 45 which may be loosened to allow the plates 43 to be slid toward or away from one another and retightened to set the width of the outlet opening 24. Width adjustment is important to optimize flow velocity through the nozzles 34 and 38 and to maintain adequate air flow volume through the drying oven.

Figure 4:
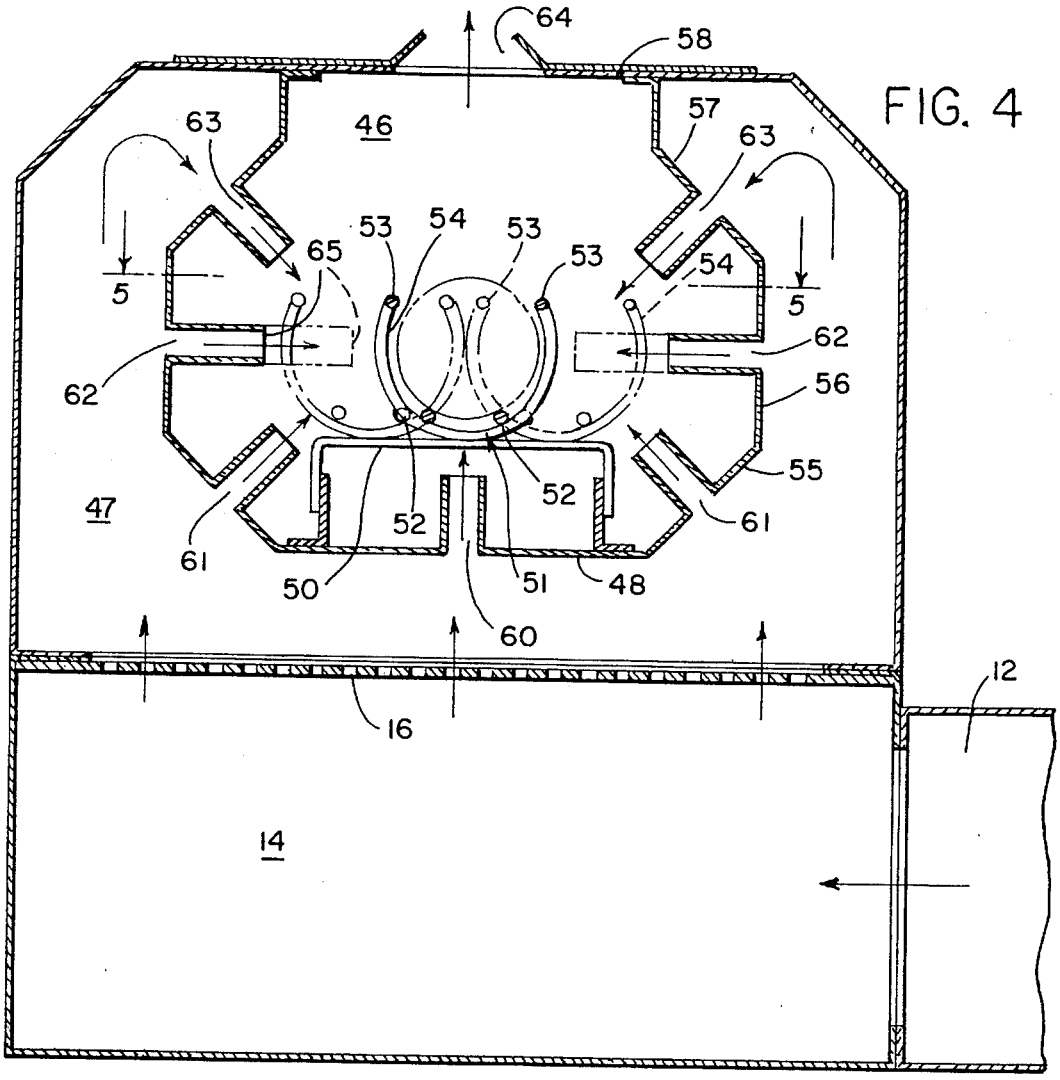
FIG. 4 is a sectional end elevation of an alternate embodiment of the invention.

Referring also to FIGS. 4 and 5, in order to adequately dry certain can ends, for example very large diameter steel ends 37 (FIG. 7) it may be desirable to increase the number of nozzles and/or to provide nozzles of somewhat different shape and orientation. In this embodiment, a drying chamber 46 is mounted within an air supply plenum 47 in a manner similar to the previously described embodiment. The drying chamber 46 includes a track support structure 50 supporting the track 51 above the bottom wall 48. The track 51 includes a pair of can end support rails 52, a pair of upper side rails 53, all of which rails are interconnected by the upwardly opening retaining rings 54, in the same manner previously described with respect to the embodiment of FIGS. 1 and 2. The track 51 defines a similar serpentine path for the line of can ends, a portion of which path may be seen in the plan view of FIG. 5.

The drying chamber 46 may be configured to provide an array of seven nozzles, as shown, or more or less as required, while still providing a nozzle array which substantially surrounds the track 51 and provides a uniform flow of drying air across the line of can ends traveling on the track. In addition, one or more nozzles, and preferably an opposed pair thereof, may include outlet slots which are contoured to conform to the curvature of the track, as will be described hereinafter.

The cross sectional shape of the drying chamber 46, as seen in FIG. 4, is more or less octagonal. Each of the walls defining the drying chamber, except for the upper wall 58, is provided with a nozzle. Thus, the bottom wall 48 includes a vertical nozzle 60, each of the lower angled walls 55 is provided with a lower angled nozzle 61, each of the vertical walls 56 is provided with a horizontal nozzle 62, and each of the upper angled walls 57 includes an upper angled nozzle 63. The upper wall 58 includes an air outlet slot 64 which may be of the same basic construction as the adjustable outlet slot 24 of the previously described embodiment.

Depending on the drying air requirements for a particular type and size of can end, various nozzle arrays may be utilized. For example, an array of three nozzles including the lower vertical nozzle 60 and the two upper angled nozzles 63 would provide a drying air flow that substantially surrounds and impinges on the line of can ends from all sides. The full array of seven nozzles shown in FIG. 3 would provide a maximum air flow, but that array may be varied by eliminating the vertical nozzle 60 or the pair of lower angled nozzles 61 while still maintaining a substantially complete track-enveloping flow of drying air.

Referring particularly to FIG. 5, the pair of horizontal nozzles 62 extending from the side walls 56 also run the full length of the drying chamber 46, but include curved outlet slots 65 which conform to the curvature of the serpentine track 51 so that the curved outlet slot 65 is always maintained equidistant from the edges of the can ends in the serpentine line moving along the track. The curved outlet slots 65 deliver air more directly and efficiently to the edges of the can ends and, because of the horizontal symmetry of the track, the horizontal curved nozzles 62 provide uniform oppositely directed drying air streams needed to maintain uniform and efficient drying. Of course, nozzle arrays including nozzles in addition to the pair of horizontal curved nozzles 62 may also be utilized.

As is described in the above identified prior art patent, two or more tracks 18 or 51 can be provided in a single can end drying oven 10 but, in order to provide the uniformly directed drying air flows which substantially surround the tracks, it is preferred that each track in a multi-track oven include its own drying chamber 17 or 46. U.S. Pat. No. 4,333,246 describes a drive or pusher mechanism for engaging the opposite edges of the can ends in a line to provide the motive force to convey the line along the track and through the drying chamber. Other line driving or pushing mechanisms may also be used and, typically, such pusher mechanisms may comprise an independent unit that includes a feeder track section which joins the main drying chamber track at the can end inlet opening 22 (see FIG. 3). However, the line pusher mechanism forms no part of the subject invention and any suitable mechanism for continuously advancing a line of can ends along the track and through the oven may be utilized.

Various modes of carrying out the present invention are contemplated as being within the scope of the following claims particularly pointing out and distinctly claiming the subject matter which is regarded as the invention.

I claim:

1. A can end drying oven of the type having a pair of rails forming a serpentine track for supporting a line of disk-shaped can ends in face-to-face relation for movement along the track through a drying chamber which includes a pair of linear nozzles positioned along the track to direct convergent streams of heated drying air against the line of moving can ends, wherein the improvement comprises an array of four linear nozzles, each positioned along the track in the drying chamber and spaced from one another circumferentially around the track to provide pairs of generally opposed drying air streams and a generally uniform flow of air across the moving line of can ends.

2. The can end drying oven as set forth in claim 1 including a drying air supply plenum enclosing and substantially surrounding the drying chamber and in open communication with said nozzles.

3. The can end drying oven as set forth in claim 1 wherein at least one of said nozzles includes an outlet slot which is curved to conform to the curvature of the serpentine path.

4. A can end drying oven of the type having a pair of rails forming a serpentine track for supporting a line of disk-shaped can ends in face-to-face relation for movement along the track through a drying chamber which includes a pair of linear nozzles positioned along the track to direct opposed streams of heated drying air against the line of moving can ends, wherein the improvement comprises opposed pairs of nozzles on opposite sides of the track to provide pairs of generally opposed drying air streams, each of one of said nozzle pairs having an outlet slot curved to conform to the curvature of the serpentine path and substantially equally spaced from the line of can ends along the track.

5. The can end drying oven as set forth in claim 4 wherein said pair of nozzles is positioned to lie in the plane of the serpentine path.

6. A can end drying oven of the type having a pair of rails forming a serpentine track for supporting a line of disk-shaped can ends in face-to-face relation for movement along the track through a drying chamber which includes a pair of linear nozzles positioned along the track to direct convergent streams of heated drying air against the line of moving can ends, wherein the improvement comprises an array of at least three linear nozzles, each positioned along the track in the drying chamber and spaced from one another circumferentially around the track to provide a generally uniform flow of air across the moving line of can ends; and;

an outlet slot in the drying chamber extending substantially the full length thereof, said outlet slot defined by a pair of laterally adjustable outlet plates.

* * * * *